US011629929B2

(12) United States Patent
Tarazon

(10) Patent No.: US 11,629,929 B2
(45) Date of Patent: Apr. 18, 2023

(54) DEVICE FOR ILLUMINATING BBS EMANATING FROM AN AIRSOFT GUN AND METHOD THEREFOR

(71) Applicant: Scott Tarazon, Tempe, AZ (US)

(72) Inventor: Scott Tarazon, Tempe, AZ (US)

(73) Assignee: Scott G Tarazon, Tempe, AZ (US)

( * ) Notice: Subject to any disclaimer, the term of this patent is extended or adjusted under 35 U.S.C. 154(b) by 173 days.

(21) Appl. No.: 14/276,342

(22) Filed: May 13, 2014

(65) Prior Publication Data

US 2015/0330738 A1 Nov. 19, 2015

(51) Int. Cl.
*F41B 11/70* (2013.01)

(52) U.S. Cl.
CPC ..... *F41B 11/70* (2013.01)

(58) Field of Classification Search
CPC ..... F41B 11/00; F41B 11/71; F41G 1/34
USPC ..... 42/146, 132
See application file for complete search history.

(56) References Cited

U.S. PATENT DOCUMENTS

| | | | | |
|---|---|---|---|---|
| 3,760,735 | A | 9/1973 | Schmitt | |
| D374,463 | S | 10/1996 | Butler et al. | |
| 6,061,918 | A * | 5/2000 | Schnell | 42/121 |
| 8,007,608 | B1 | 8/2011 | Herbage et al. | |
| 8,146,577 | B2 | 4/2012 | Hu | |
| 2004/0099173 | A1 | 5/2004 | Rector et al. | |
| 2005/0224062 | A1 | 10/2005 | Shih | |
| 2009/0133679 | A1 | 5/2009 | Yeh | |
| 2011/0107935 | A1 | 5/2011 | Authement, Sr. | |

FOREIGN PATENT DOCUMENTS

| | | |
|---|---|---|
| EP | 97905731.2 | 5/2003 |

* cited by examiner

*Primary Examiner* — Karabi Guharay
(74) *Attorney, Agent, or Firm* — Jeffrey D Moy; Weiss & Moy, P.C.

(57) ABSTRACT

A device for illuminating BBs emanating from an airsoft gun has a lighting element positioned proximate a breech area of the airsoft gun to illuminate the breech area. A switching device is coupled to the lighting element. A power source is coupled to the switching device and the lighting element.

7 Claims, 3 Drawing Sheets

DEVICE FOR ILLUMINATING BBS EMANATING FROM AN AIRSOFT GUN AND METHOD THEREFOR

TECHNICAL FIELD

The present application generally relates to a firearm that dispenses BBs, and, more particularly, to an airsoft gun that has a device for illuminating BBs emanating from the airsoft gun so that the BBs appear to be tracer rounds.

BACKGROUND

Airsoft guns are replica firearms generally used for recreational purposes. Airsoft guns generally fire plastic BBs by way of compressed gas or electric and/or spring-driven pistons. Depending on the mechanism driving the pellet, an airsoft gun can be operated manually or cycled by either compressed gas such as Green Gas (propane and silicone mix) or $C_{O2}$ or by compressed air via a spring or an electric motor pulling a piston.

While airsoft guns may fire hard plastic BBs, they are less dangerous than metal BB projectiles. This may be due to the fact that the hard plastic BBs are less massive and therefore carry less momentum at a given velocity. Hence, airsoft players often fire airsoft guns at other players during airsoft games and competitions, without significant injury (so long as eyes are well protected).

While many airsoft guns have a realistic appearance, most users may desire a more authentic look an appearance when the airsoft gun is being fired. For example, when using an airsoft gun, it may be desirable to see a muzzle flash when the airsoft gun is fired. Alternatively, it further may be desirable to have the airsoft gun fire what appears to be a tracer round.

Therefore, it would be desirable to provide an airsoft gun device and method that overcome the above problems.

SUMMARY

This summary is provided to introduce a selection of concepts in a simplified form that are further described below in the DESCRIPTION OF THE APPLICATION. This summary is not intended to identify key features of the claimed subject matter, nor is it intended to be used as an aid in determining the scope of the claimed subject matter.

A device for illuminating BBs emanating from an airsoft gun has a lighting element positioned proximate a breech area of the airsoft gun to illuminate the breech area. A switching device is coupled to the lighting element. A power source is coupled to the switching device and the lighting element.

A device for illuminating BBs emanating from an airsoft gun has a lighting element positioned proximate to and in communication with a breech area of the airsoft gun to illuminate the breech area. A switching is device coupled to the lighting element. A power source is coupled to the switching device and the lighting element.

A device for illuminating BBs emanating from an airsoft gun has an opening formed into a breech area of the airsoft gun. A lighting element is positioned in the opening and in communication with a breech area of the airsoft gun to illuminate the breech area. A switching device is coupled to the lighting element. A power source is coupled to the switching device and the lighting element.

BRIEF DESCRIPTION OF DRAWINGS

Embodiments of the disclosure will become more fully understood from the detailed description and the accompanying drawings, wherein.

DESCRIPTION OF THE APPLICATION

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure.

Figure 1:
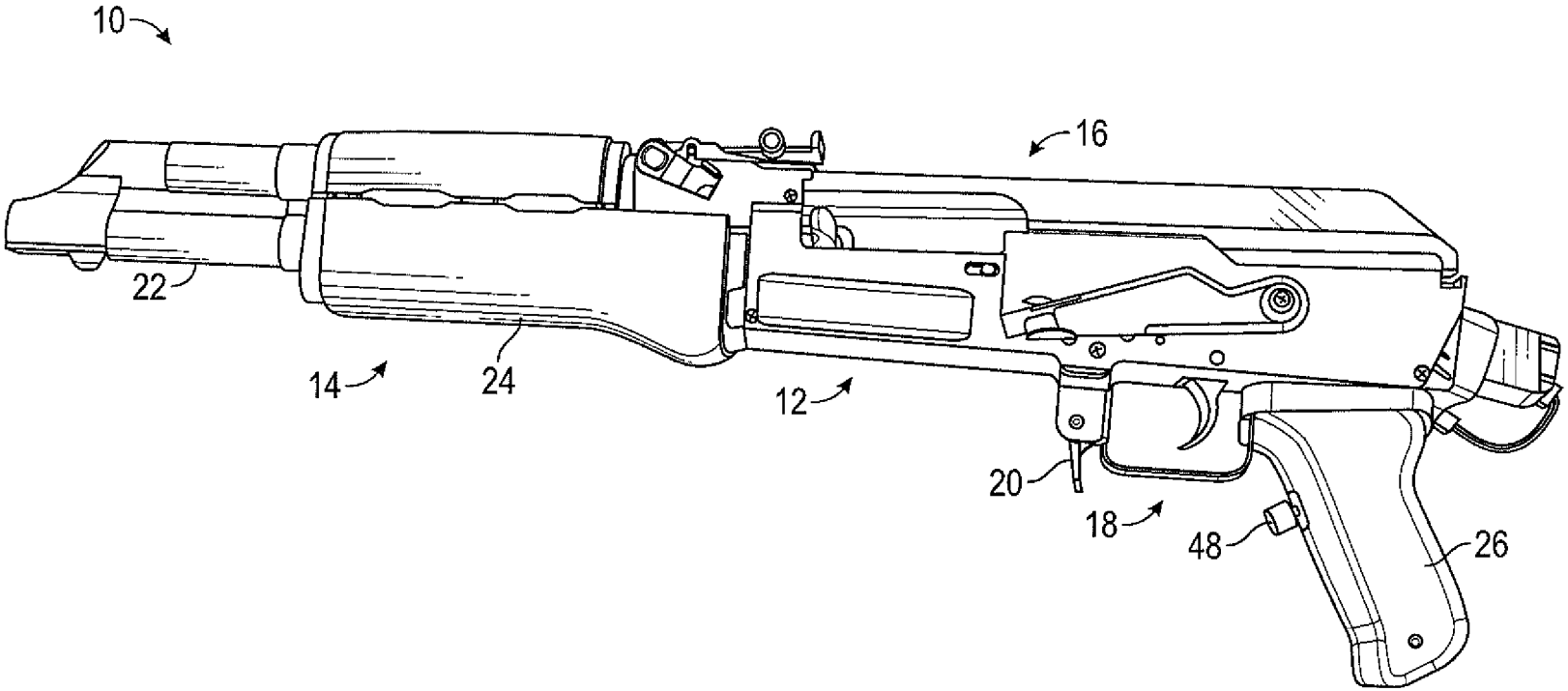
FIGS. 1 is a side view of an exemplary embodiment of an airsoft gun incorporating a device for illuminating BBs emanating from the airsoft gun.
Figure 2:
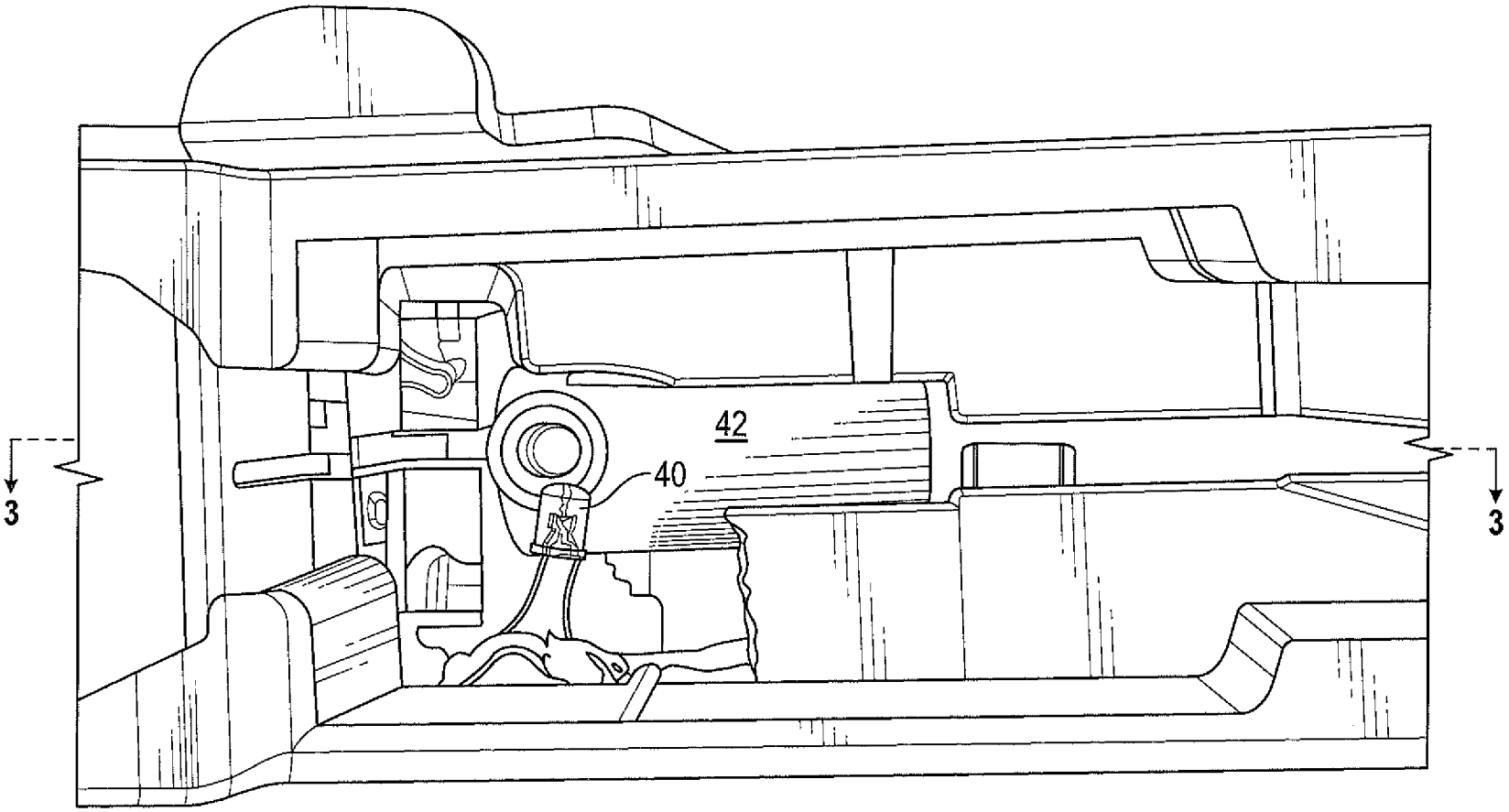
FIG. 2 is a magnified top view of the airsoft gun shown in FIG. 1 showing a breech area of the airsoft gun.
Figure 3:
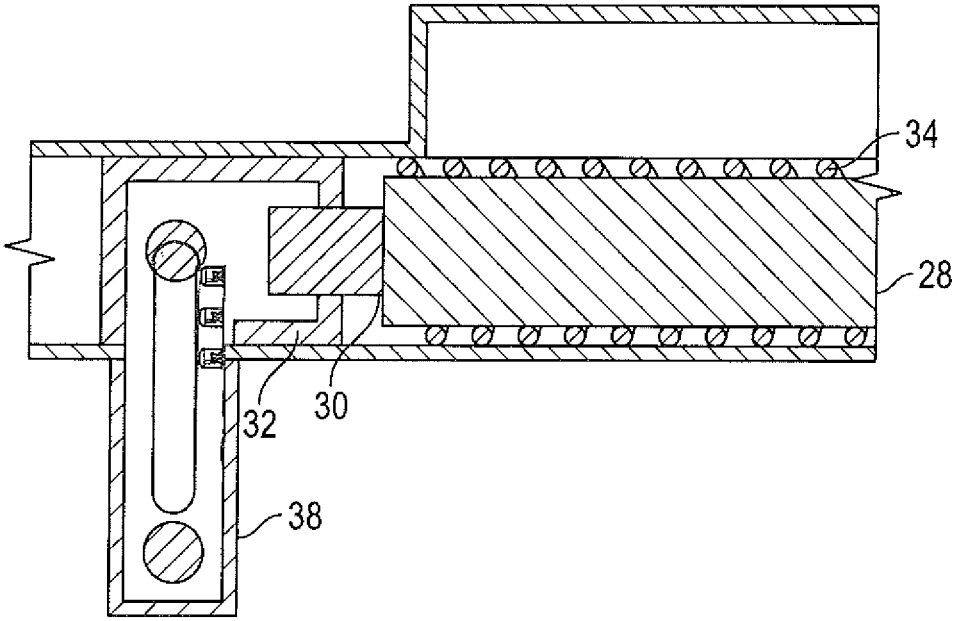
FIG. 3 is a cross sectional view of the airsoft gun depicted in FIG. 2 taken along lines 3-3.

Referring to FIGS. 1-3, an exemplary embodiment of an airsoft gun 10 incorporating a device 12 for illuminating BBs emanating from the airsoft gun 10 may be disclosed. The airsoft gun generally may have a gun body 14, a firing assembly 16, a trigger assembly 18 and a selector switch 20. A refill device may also be coupled to the airsoft gun 10 and may be used to feed plastic BBs into the airsoft gun 10.

The gun body 14 may include a barrel 22, hand guard 24 and a stock or pistol grip area 26. The stock or pistol grip area 26 is generally a back portion of the airsoft gun 10. The stock or pistol grip area 26 may be adjustable. The stock or pistol grip area 26 may be used to allow a user to grip and or hold the airsoft gun 10 to find a correct positioning for firing the airsoft gun 10. The hand guard 24 may be positioned towards the front of the airsoft gun 10. The hand guard 24 may be used to allow a user to grip the front end of the airsoft gun 10 to find a correct positioning for firing the airsoft gun 10. The barrel 22 may run horizontal to and extend out from the hand guard 24. The barrel 22 may be used to discharge the plastic BBs from the airsoft gun 10. The barrel 10 may be designed to impart a back-spin put on the plastic BBs and to increase the range via the Magnus effect.

The firing assembly 16 is generally positioned within the gun body 14. The firing assembly 16 may be used to propel the plastic BBs through the barrel 22 and out of the airsoft gun 10. The firing assembly 16 may include a cylinder member 28 having a cylinder head member 30 extending out from the cylinder member 28. The cylinder member 28 may be positioned in and slide within a cylinder sleeve member 32. A piston assembly 34 may be coupled to the cylinder member 28. The piston assembly 34 may be used to move the cylinder member 28 thereby propel the plastic BBs through the barrel 22 and out of the airsoft gun 10. The piston assembly 34 may be powered by compressed gas such as Green Gas (propane and silicone mix) or $C_{O2}$ or by compressed air via a spring or an electric motor.

A trigger assembly 18 may be coupled to the firing assembly 16. The trigger assembly 18 may be used for actuating the piston assembly 34. The airsoft gun 10 may have a selector switch 20. The selector switch 20 may be used to place the airsoft gun 10 in a safety mode, a fully automatic mode or a semi-automatic mode.

Referring now to FIGS. 2-4, the airsoft gun 10 may have an illuminating circuit 36 for illuminating the plastic BBs 38 emanating from the airsoft gun 10 so that the plastic BBs 38 appear to be tracer rounds. The illuminating circuit 36 may have a lighting element 40. The lighting element 40 may be a single lighting element 40 or a plurality of lighting elements 40. The lighting element 40 may be a Light Emitting Diode (LED), fluorescent, incandescent or the like. The above listing is given as an example and should not be seen in a limiting manner. The lighting element 40 may be comprised of one or more The lighting element 40 may be positioned approximate a breech area 42 of the airsoft gun 10. The breech area 42 may be located in a rear area of the barrel 22. The lighting element 40 may be positioned such that light emanating from the lighting element 40 may penetrate into the breech area 42, The lighting element 40 may not actually be positioned in the breech area 42. However, an opening 50 may be formed in the cylinder sleeve member 32 into the breech area 42. The opening 50 may allow light emanating from the lighting element 40 to penetrate into the breech area 42 without the lighting element 40 interfering with movement of any components in the breech area 42. As shown more clearly in FIG. 3, a plurality of lighting elements 40 may be aligned vertically in the breech area 42. The plurality of lighting element 40 may be positioned proximate the opening 50 formed in the cylinder sleeve member 32 into the breech area 42.

The device 36 may further have a switching element 43 coupled to the lighting element 40. The switching element 43 may be used to connect a power source 44 to the lighting element 40 thereby illuminating the lighting element 40. In accordance with one embodiment, the switching element 43 may be a normally open switch whereby pressing the switching element 42 closes the switching element 43 to connect the power source 44 to the lighting element 40.

The switching element 43 may be positioned anywhere on the airsoft gun 10. However, for ease of use of the illuminating circuit 36, the switching element 42 may be positioned to be easily accessed by the user. For example, in accordance with one embodiment, the switching element 43 may be postponed on the stock or pistol grip area 26 of the airsoft gun 10. The above is given as an example and should not be seen in a limiting manner.

The power source 44 may be a battery or the like. In accordance with one embodiment, the power source 44 may be a rechargeable battery. The power source 44 may be positioned in different areas of the airsoft gun 10. In general, the power source 44 may be located in an area of the airsoft gun 10 that may be easily accessible.

In operation, once the firing assembly 16 has set, the user may press the switching element 43 to illuminate the lighting element 40. This may allow light emanating from the lighting element 40 to shine on a plastic pellet 38 in the breech area 42 of the barrel 22. If the plastic BBs 38 are coated with a photoluminescent material, the plastic BBs 38 may re-emit the radiation absorbed from the light emanating from the lighting element 40. In accordance with one embodiment, the photoluminescent material may be a phosphorescent material. The phosphorescent material may not immediately re-emit the radiation it absorbs. The slower time scales of the re-emission may allow the absorbed radiation to be re-emitted at a lower intensity for a longer period of time.

Thus, the lighting element 40 illuminates each plastic pellet 38 as each plastic pellet enters the breech area 42 of the barrel 22. The plastic BBs 38 then may re-emit the radiation absorbed from the lighting element 40 as each plastic pellet 38 exits the barrel 22. Thus, the glowing plastic BBs 38 may be visible when the air gun 10 is fired in darkened rooms and or outside at night thereby appearing as tracer rounds.

While embodiments of the disclosure have been described in terms of various specific embodiments, those skilled in the art will recognize that the embodiments of the disclosure may be practiced with modifications within the spirit and scope of the claims.

What is claimed is:

1. A device causing a phosphorescent projectile to glow when expelled from an airsoft gun comprising:

an internal lighting element contained inside an airsoft gun housing;

an opening formed in a cylinder sleeve member of the airsoft gun;

a switching device coupled to the internal lighting element; and an airsoft gun battery coupled to the switching device and the internal lighting element;

wherein the internal lighting element illuminates through the opening formed in the cylinder sleeve member illuminating phosphorescent bbs contained inside the cylinder sleeve member before they are expelled from the airsoft gun.

2. The device of claim 1 wherein the lighting element is internal and illuminates inward into the cylinder sleeve member.

3. The device of claim 1 wherein the phosphorescent projectile is caused to glow in the dark when expelled from the airsoft gun.

4. A device causing a phosphorescent projectile to glow in the dark when expelled from an airsoft gun comprising:

an internal lighting element contained inside a housing of the airsoft gun; and a transparent cylinder sleeve member;

wherein illumination from the internal lighting element comes into communication with a phosphorescent bb through a wall of the transparent cylinder sleeve member, the phosphorescent bb absorbs the illumination through the wall of the cylinder sleeve member and glows.

5. The device of claim 4 wherein the internal lighting element illumination is directed inward and penetrates the wail of the transparent cylinder sleeve member.

6. The device of claim 4 wherein the internal lighting element communicates with the phosphorescent bb inside causing it to glow in the dark.

7. The device of claim 4 wherein the phosphorescent bb is caused to glow in the dark when expelled from the airsoft gun.

* * * * *